United States Patent [19]

Marsault

[11] Patent Number: 4,972,806

[45] Date of Patent: Nov. 27, 1990

[54] DEVICE ENABLING A MASS CANTILEVERED FROM A VERTICALLY MOVEABLE ELEMENT TO REST AGAINST A FIXED FRAMEWORK

[75] Inventor: Jean-Jacques Marsault, Bures Sur Yvette, France

[73] Assignee: Societe Anonyme dite: Stein Industrie, Velizy-Villacoublay, France

[21] Appl. No.: 447,334

[22] Filed: Dec. 7, 1989

[30] Foreign Application Priority Data

Dec. 8, 1988 [FR] France ..... 88 16139

[51] Int. Cl.[5] ..... F22B 37/24

[52] U.S. Cl. ..... 122/510; 165/81; 165/162; 248/901

[58] Field of Search ..... 165/81, 162; 122/510; 248/901

[56] References Cited

U.S. PATENT DOCUMENTS

| | | | |
|---|---|---|---|
| 3,951,108 | 4/1976 | Rees . | |
| 4,137,967 | 2/1979 | Hirschle | 122/510 X |
| 4,190,104 | 2/1980 | Frei | 165/162 |
| 4,384,696 | 5/1983 | Blake | 248/901 X |

FOREIGN PATENT DOCUMENTS

| | | |
|---|---|---|
| 2106036 | 8/1972 | Fed. Rep. of Germany . |
| 1466918 | 1/1967 | France . |
| 1075104 | 7/1967 | United Kingdom . |

*Primary Examiner*—Edward G. Favors

*Attorney, Agent, or Firm*—Sughrue, Mion, Zinn, Macpeak & Seas

[57] ABSTRACT

A device enabling a mass (1) cantilevered from an element (2) which is vertically moveable under the effect of thermal expansions and contractions to rest against a fixed framework (9). The device comprises a first arm (7) articulated on a point (C) of the vertically moveable element, a second arm (6) articulated firstly to one end (B) of the first arm adjacent to the mass and slidably placed on this junction, and secondly to the fixed framework, and a third arm (8) articulated firstly to one end (2) of the first arm adjacent to the vertically moveable element, and secondly to the fixed framework (9) at a point (D) at a level different from that of the point (E) at which the second articulated arm is articulated thereto. The invention is applicable to the manifolds of boilers or steam generators.

5 Claims, 3 Drawing Sheets

Figure 1:
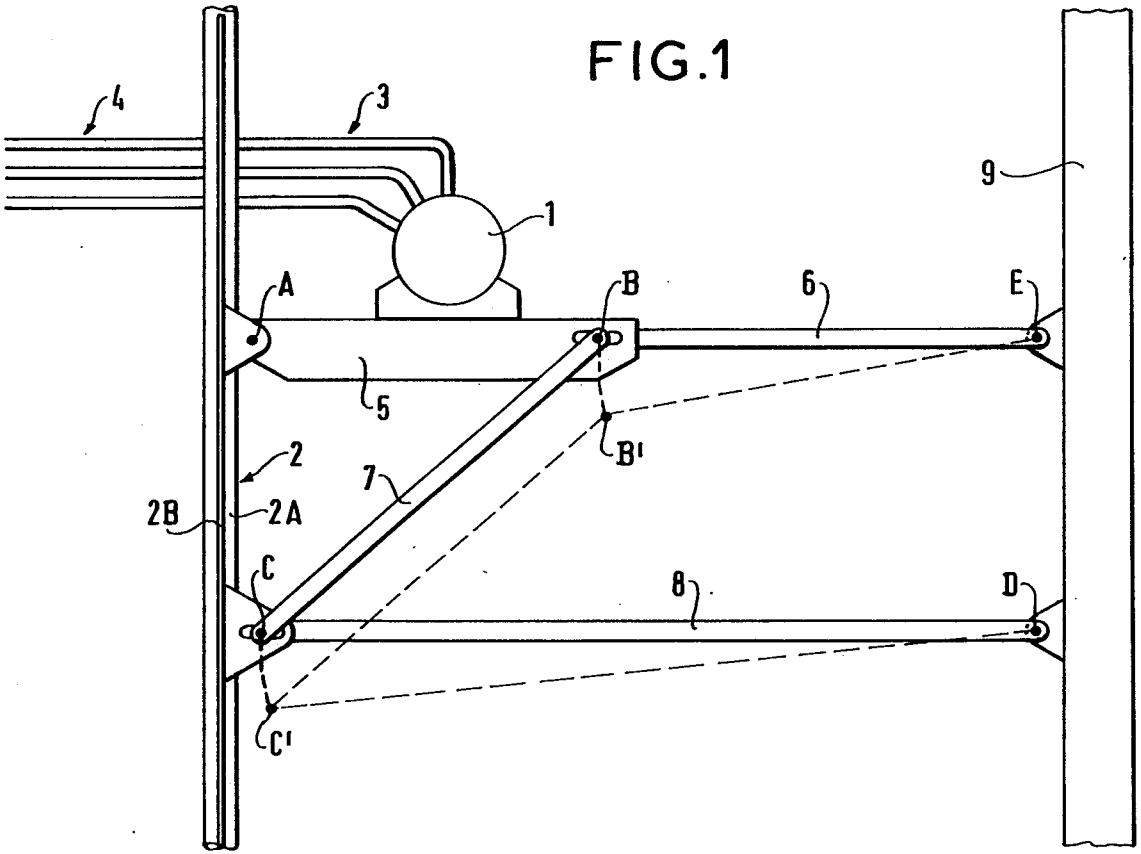

DEVICE ENABLING A MASS CANTILEVERED FROM A VERTICALLY MOVEABLE ELEMENT TO REST AGAINST A FIXED FRAMEWORK

The present invention relates to a device enabling a mass cantilevered out from an element that is vertically moveable under the effect of thermal expansion and contraction to rest against a fixed framework.

Devices of this nature are used, in particular, in boilers or steam generators, in which the problem frequently arises of suspending masses such as manifolds from the walls of combustion chambers, having tubes for conveying a flow of water to be turned into steam which are subjected to considerable expansions and contractions as a function of the temperature of the fluid flowing in them. These manifolds are cantilevered out from the wall constituted by the tubes and it is absolutely essential that they be capable of following the movement of such a wall without applying forces thereto that could deform it.

Proposals have already been made to suspend such manifolds from spring supports for carrying a portion of the weight that is cantilevered out while still being capable of following movements of the mass without too great a variation in the force they provide. However, such springs act only as counterweights and they control the vertical position of the mass only by applying parasitic forces on the walls of the combustion chamber, which forces increase with increasing lack of uniformity in the force to be taken up by the springs, since said force depends on forces of variable magnitude applied via the interconnecting pipework connected to the manifolds. In addition, the manifolds do not remain in exactly the same place relative to the wall of the combustion chamber.

Proposals have thus been made to support such manifolds by vertical support tubes having a fluid flowing therethrough which imparts thermal expansion thereto equal to the thermal expansion of the wall of the steam generator. The manifolds are then indeed supported at a point which is fixed relative to the wall of the combustion chamber. However, such devices are complex and expensive, and their operation may be disturbed by the fact that the thermal expansion of the vertical support tubes may be delayed relative to that of the combustion chamber wall, or that the fluid flow in the support tubes may not be adequate. In either case the thermal expansion of the vertical support tubes is no longer equal to the thermal expansion of the combustion chamber, and as a result unacceptable stresses may appear in the combustion chamber wall.

Finally, French patent specification FR-A-No. 2 269 023 proposes taking up the weight of cantilevered manifolds or burners for combustion chambers by means of systems of levers whose pivots are fixed to a fixed framework and are disposed in such a manner that the displacements of the support point of the manifold or of the burner are equal to the displacement of the connection point on the wall of the combustion chamber. However, the levers of such systems are subjected to bending stresses, and the sum of their bending deformations degrades the stiffness of the assembly unless they are excessively dimensioned.

The object of the present invention is to provide a rigid support device for such cantilevered masses having displacements that accurately follow the displacements of the vertically moveable element, and constituted by elements which are not subjected to bending stresses, but only to compression and traction stresses.

The device of the invention is characterized in that it comprises a first arm articulated on a point of the vertically moveable element, a second arm articulated firstly to one end of the first arm adjacent to the mass and slidably placed on this junction, and secondly to the fixed framework, and a third arm articulated firstly to one end of the first arm adjacent to the vertically moveable element, and secondly to the fixed framework at a point at a level different from that of the point at which the second articulated arm is articulated thereto.

It preferably satisfies one or other of the following characteristics:

the first arm and the second arm are articulated with the possibility of sliding horizontally on a plane support connected to the mass, the first and third arms are articulated with the possibility of sliding horizontally on the vertically moveable element, and the second and third arms are articulated on the fixed framework without being allowed to slide;

the point at which the second arm is articulated to the fixed framework is at a level which is lower than the point at which it is articulated to the first arm; and the point at which the first and second arms are articulated to the mass is connected to a suspension member for said mass, disposed above said mass, and located beneath the points at which the third arm is articulated to the first arm and to the fixed framework.

In addition, each embodiment of the device may also include a support for the mass exerting a constant upwards traction force thereon.

Figure 2:
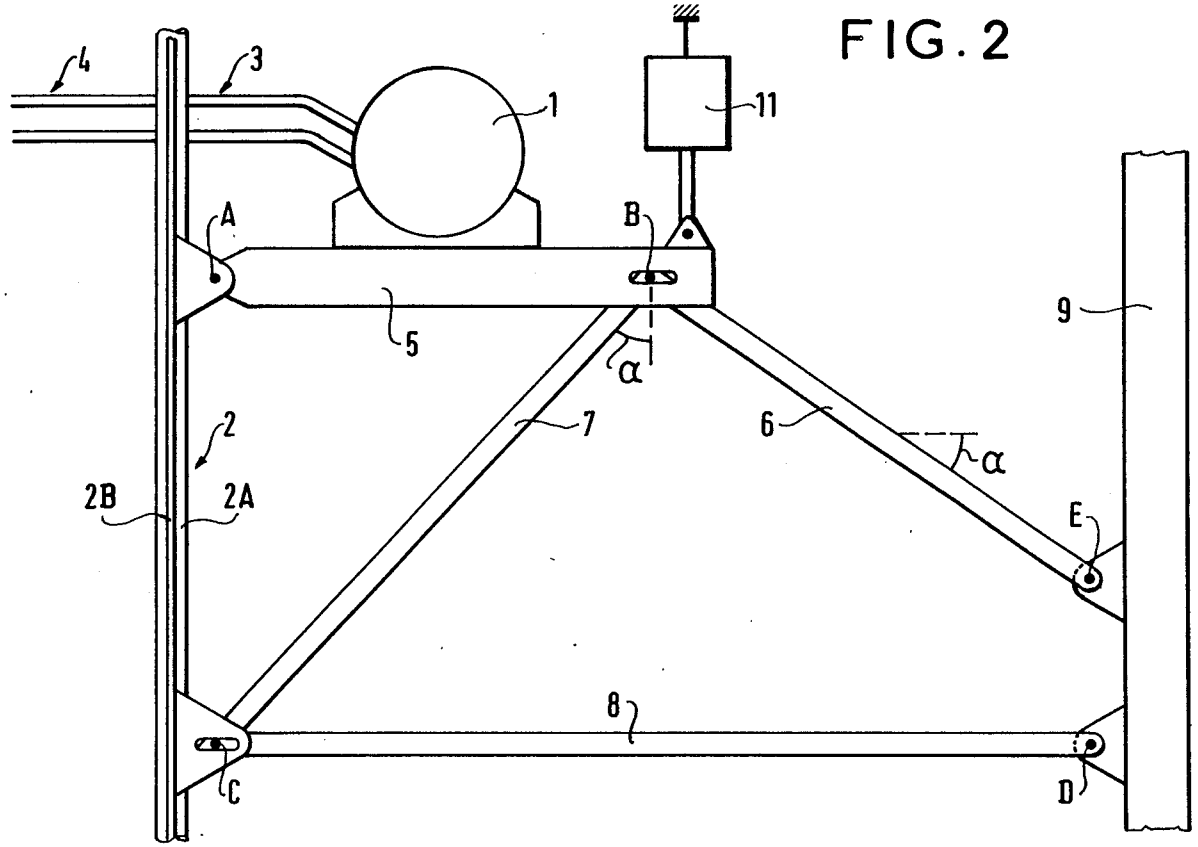
Figure 3:
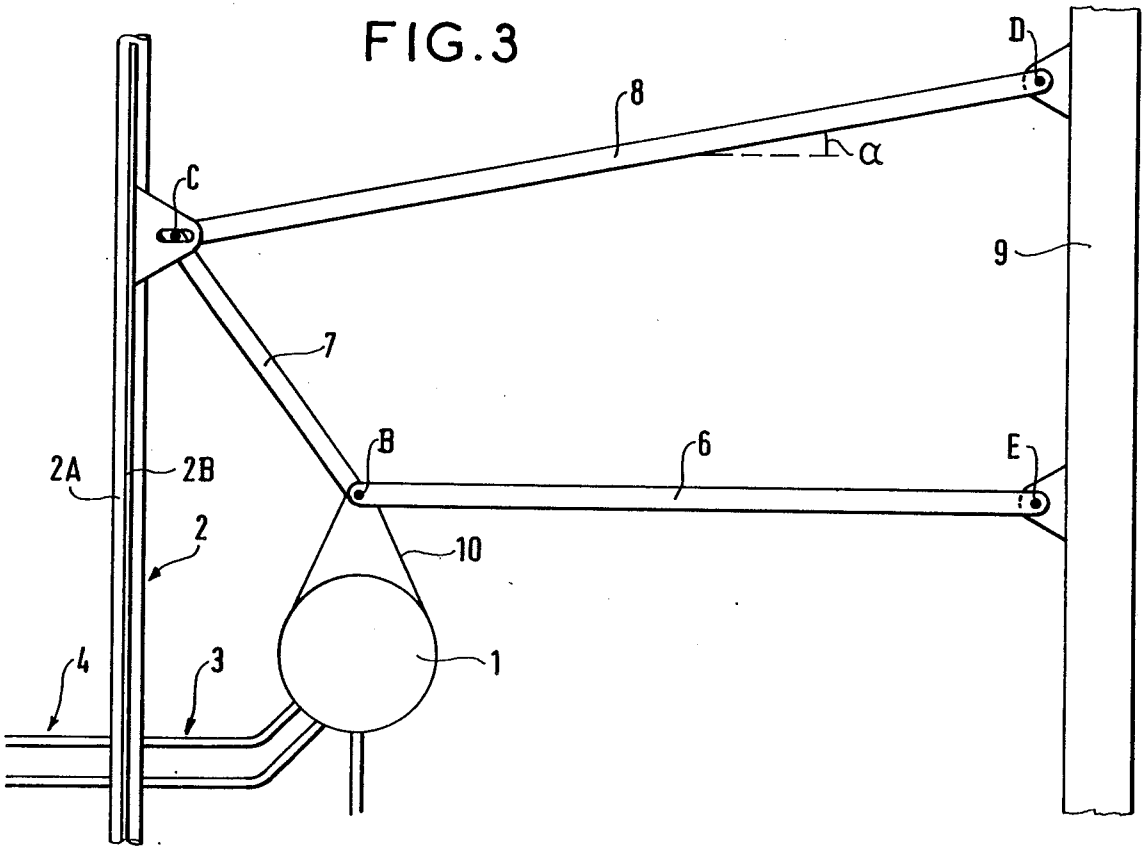

Various devices in accordance with the invention for enabling a cantilevered mass to rest against a fixed framework are described below by way of example and with reference to the accompanying drawings. In all of the embodiments described, the mass is constituted by a steam manifold cantilevered out from a screen which is formed by pipework in which water to be vaporized flows over the walls of a combustion chamber in a boiler or a steam generator. In the drawings:

FIG. 1 is a diagrammatic elevation view of a first variant of a device in which the second and third arms remain substantially horizontal and are articulated with the possibility of sliding like the first arm on the manifold support and on the screen constituted by the steam-forming tubes and their interconnecting fins;

FIG. 2 is an elevation view of a second variant of the device in which the second arm is at a significant angle to the horizontal such that vertical displacement of the point of articulation on the manifold support is proportional to the displacement of the articulation point on the screen formed by the steam-forming tubes, and is no longer equal thereto, a constant support for the manifold being also connected by a supporting element to a fixed framework extending thereabove; and FIG. 3 is an elevation view of a third variant device in which the manifold is suspended from an articulation, instead of being above it.

In FIG. 1, the steam manifold 1 is fixed relative to a partition 2 constituted by tubes 2A and interconnecting fins 2B, in a combustion chamber in a boiler, in such a manner that its connecting tubes 3 connected to the tubes of a superheater 4 are not subjected to stresses due to differential expansion between the manifold and the partition.

The manifold is fixed on a cross-member 5 pivotally connected to a point A on the partition 2. A second bearing point for the cross-member is constituted by a hinge B at the other end of the cross-member and against which the cross-member bears via a sliding connection.

The hinge B belongs to a system constituted by articulated arms 6, 7, and 8. The arms 7 and 8 are connected to a point C which is fixed to the partition 2 beneath the point A, said connection being suitable for enabling the arms both to rotate and to slide. The arms 6 and 8 are fixed at respective points E and D to a fixed vertical framework 9, said fixings being capable of pivoting.

If the wall 2 expands because it is heated, then the point C moves down to C′ and the point B moves down to B′, with the distance B′ C′ being kept equal to the distance BC by the arm 7. The vertical projection of the segment BB′ is very substantially equal to the vertical projection of the segment CC′. Indeed, it would be exactly the same if the quadrilateral BCDE were a parallelogram, which could be achieved by making the segment DE parallel to CB, in which case the point D would not longer be vertically below the point E.

FIG. 2 shows a support device in which the arm 6 slopes relative to the horizontal at an angle $\alpha$, with the other arms being unchanged relative to FIG. 1, such that the vertical displacement of the point B which is constrained to follow a circle of radius BE is substantially proportional to and less than the displacement of the point C instead of being equal thereto. This makes it possible to provide a response to the fact that during thermal expansion, the point C on the partition generally moves down further than the point A. In addition, the end of the cross-member 5 is fixed to a constant support element including springs 11, thereby enabling the system of arms to be dimensioned so as to support only a fraction of the total load, and thus reducing the vertical load transmitted to the partition 2 constituted by the steam-generating tubes.

In FIG. 3, the manifold 1 is no longer carried by a cross-member, but is suspended by a fastening member 10 from the articulation point B.

In this case it is the arm 8 which is at an angle $\alpha$ to the horizontal, such that the vertical displacement of the point B is again substantially proportional to or greater than that of the point C.

It will be observed that in all of the above variants, none of the articulation arms is subjected to any bending stress, with the arms being subjected solely to traction or compression stresses, thereby making it possible to give them right cross-sections that are considerably smaller than those of the arms in prior devices which operate in bending.

The invention is particularly applicable to suspending a manifold from the wall of a combustion chamber in a boiler or steam generator, but it is also applicable to the suspension of other apparatuses such as burners.

What is claimed:

1. A device enabling a mass (1) cantilevered from an element (2) which is vertically moveable under the effect of thermal expansions and contractions to rest against a fixed framework (9), the device being characterized in that it comprises a first arm (7) articulated on a point (C) of the vertically moveable element, a second arm (6) articulated firstly to one end (B) of the first arm adjacent to the mass, and secondly to the fixed framework, and a third arm (8) articulated firstly to one end (2) of the first arm adjacent to the vertically moveable element, and secondly to the fixed framework (9) at a point (D) at a level different from that of the point (E) at which the second articulated arm is articulated thereto.

2. A device according to claim 1, wherein the first arm (7) is articulated so as to slide horizontally on a plane support (5) connected to the mass (1), wherein the first and third arms (7, 8) are articulated so as to slide horizontally on the vertically moveable element (2), and wherein the second and third arms (6,8) are articulated on the fixed framework without being allowed to slide.

3. A device according to claim 2, wherein, the point (E) at which the second arm is articulated to the fixed framework is at a level which is lower than the point (B) at which it is articulated to the first arm.

4. A device according to claim 1, wherein the point (B) at which the first and second arms are articulated to the mass is connected to a suspension member (10) for said mass, disposed above said mass, and located beneath the point (C) at which the third arm (8) is articulated to the first arm (7) and beneath point (D) at which the third arm (8) is articulated to the fixed framework (9).

5. A device according to claim 1, further including a spring support (11) for the mass exerting a constant upwards traction force thereon.

* * * * *